US007353831B1

(12) United States Patent
Forsline et al.

(10) Patent No.: US 7,353,831 B1
(45) Date of Patent: Apr. 8, 2008

(54) CONTAINER FOR STORING PRESSED POWDERS

(75) Inventors: Ladd Forsline, 16 Gehringer Dr., Kutztown, PA (US) 19530; Susanna Starr, New York, NY (US)

(73) Assignee: Ladd Forsline, Kutztown, PA (US)

( * ) Notice: Subject to any disclaimer, the term of this patent is extended or adjusted under 35 U.S.C. 154(b) by 0 days.

(21) Appl. No.: 11/212,175

(22) Filed: Aug. 26, 2005

Related U.S. Application Data

(63) Continuation of application No. 11/152,015, filed on Jun. 13, 2005, now abandoned.

(60) Provisional application No. 60/578,945, filed on Jun. 11, 2004.

(51) Int. Cl.
*A45D 33/24* (2006.01)

(52) U.S. Cl. ..... 132/294

(58) Field of Classification Search ..... 132/293, 132/294, 303; 206/581, 385; 424/63, 69
See application file for complete search history.

(56) References Cited

U.S. PATENT DOCUMENTS

| | | | | |
|---|---|---|---|---|
| 1,194,185 | A * | 8/1916 | Kendall | 132/293 |
| 1,213,501 | A * | 4/1917 | Kendall | 132/293 |
| 1,601,756 | A * | 10/1926 | Kendall | 132/293 |
| 1,602,981 | A * | 10/1926 | Kendall | 132/293 |
| 1,647,916 | A * | 11/1927 | Kendall | 132/293 |
| 1,771,147 | A * | 7/1930 | Spender | 132/303 |
| 2,866,467 | A * | 12/1958 | Bradford | 132/303 |
| 2,990,054 | A * | 6/1961 | Gellman | 206/37 |
| 4,337,859 | A * | 7/1982 | Murphy et al. | 206/37 |
| 4,616,748 | A | 10/1986 | Thomas et al. | |
| 5,388,689 | A | 2/1995 | Kroop et al. | |
| 5,860,518 | A | 1/1999 | Axelrod | |
| 6,173,719 | B1 * | 1/2001 | Petit | 132/294 |
| 6,524,597 | B2 | 2/2003 | Kashimoto | |

(Continued)

FOREIGN PATENT DOCUMENTS

JP 02057203 A 2/1990

(Continued)

OTHER PUBLICATIONS

Website Printout, Winsor & Newton-Oil Paint Bars, http://ww-wreuels.com/reuels/page52.html, Dec. 15, 2005, pp. 1-2.

(Continued)

*Primary Examiner*—Todd E. Manahan
(74) *Attorney, Agent, or Firm*—Patterson, Thuente, Skaar & Christensen, P.A.

(57) ABSTRACT

Pressed powders, such as cosmetics, are more effectively retained within a pan-like container having a bottom, at least one side and a top opening that defines a recess area to receive the pressed powder. Surface features are defined on the inner surface of at least the bottom of the container in order to create a generally lateral force component that the container applies to the pressed powder material to resist cracking of the pressed powder material in response to removal of a portion of the pressed powder material from the top opening. In one embodiment, a non-thermally activated adhesive layer is positioned generally along at least a portion of an inner surface of the bottom of the container.

18 Claims, 6 Drawing Sheets

U.S. PATENT DOCUMENTS

| | | | | |
|---|---|---|---|---|
| 6,698,585 | B2 | 3/2004 | Kammerer | |
| 2004/0040570 | A1* | 3/2004 | Shih | 132/293 |
| 2005/0109363 | A1 | 5/2005 | Matsuoka | |

FOREIGN PATENT DOCUMENTS

| | | | |
|---|---|---|---|
| JP | 09098830 | A | 4/1997 |

OTHER PUBLICATIONS

Website Printout, Specialty Paints, http://www.hawaiiangraphics.com/specialty_paint_page.html, Dec. 15, 2005, pp. 1-3.

Website Printout, Winsor & Newton Oil Bars, http://www.hawaiiangraphics.com/wn_oil_bar_page.html, Dec. 15, 2005, pp. 1-3.

* cited by examiner

CONTAINER FOR STORING PRESSED POWDERS

CROSS-REFERENCE TO RELATED APPLICATIONS

The current application is a continuation of U.S. patent application Ser. No. 11/152,015 filed on Jun. 13, 2005, entitled "Container for Storing Pressed Powders," now abandoned, which claims the benefit of priority from U.S. provisional patent application filed on Jun. 11, 2004, entitled "Novel Godets For Pressed Powders" having Ser. No. 60/578,945, which is incorporated herein by reference.

FIELD OF THE INVENTION

The present invention relates to receptacles and packaging for storing pressed powders, such as cosmetics. More particularly, the present invention relates to containers for storing a pressed powder that more effectively retain the pressed powder within a pan-like container.

BACKGROUND OF THE INVENTION

Pan-like containers, such as godets or compacts, have long been used to hold pressed powder formulations for cosmetic applications. These cosmetic containers come in a variety of shapes (e.g., round, square, half-round, etc.) and configurations (e.g., lid, no lid, multiple compartments, etc.). The containers are typically made of plastic or metal with a flat bottom and sides at a right angle to the bottom portion. In some of these containers, the bottom portion can include ridges that increase the structural integrity of the container. Recent examples of improvements in the design of such cosmetic containers are shown, for example, in U.S. Publ. Appl. No. 2005/0109363 and Japanese Abstracts Nos. JP/9098830 and JP/2057203.

U.S. Pat. No. 6,524,597 describes the conventional problems and techniques for manufacturing pressed powder cosmetic materials. This patent teaches a new composition for pressed powder cosmetics using a surface treatment with a fluorine compound. The resulting cosmetic pressed powder has a smooth feel and overcomes the problems of cracking and caking that occur when the hardness or durometer of the pressed powder composition is decreased.

Pressed powder cosmetic formulations can be fragile, and can easily break, chip or crack during application and/or storage of the pressed powders. Generally, pressed powder cosmetic formulations with a higher percentage of binders and/or formulations pressed at a higher pressure tend to be less fragile than those pressed at a lower pressure or with less binder content. However, as the pressed powder cosmetic is removed from the container and the level of pressed powder approaches the bottom surface of the container, the remaining pressed powder cosmetic in the container tends to become ever more fragile and prone to breakage. This is an undesirable characteristic as the remaining material that is cracked or broken is generally unusable, and is thus wasted.

Japanese Abstract No. JP/9098830 describes one embodiment of a container for pressed powder cosmetics in which a hot melt adhesive is used as part of the manufacturing process to aid in retaining the cosmetic pressed powder in the container. The use of such a holt melt adhesive, however, could have significant impact on the biocompatibility and toxicity of the cosmetic material due to both the heating of the pressed powder that can affect coloration of the pigment components and the potential leaching of the hot melt adhesive into the pressed powder composition.

While there have been numerous containers and compositions developed for pressed powder cosmetics, it would be desirable to provide for a container for pressed powders that could more effectively retain the pressed powder within the container and address the issues of cracking and caking that can occur.

SUMMARY OF THE INVENTION

The present invention relates to apparatus and methods for storing a pressed powder that more effectively retain the pressed powder within a pan-like container or godet. The container has a bottom, at least one side and a top opening that defines a recess area. In one embodiment, surface features are defined on the inner surface of at least the bottom of the container in order to create a generally lateral force component that the container applies to the pressed powder material to resist cracking of the pressed powder material in response to removal of a portion of the pressed powder material from the top opening. The surface features can define cavities in the bottom inner surfaces of the container, which facilitate the creation of a lateral force component that aids in interlocking of the pressed powder and the container.

Preferably, the surface area of the cavities occupies between about 5 percent and about 65 percent of the bottom inner surface area, and more preferably between about 20 percent and about 40 percent of the bottom inner surface area. Alternatively, the surface features can be defined in terms of an equivalent surface area that is preferably at least twice, and more preferably at least three times, that of the surface area defined by the perimeters of the container, or an equivalent roughness of the surface that is equivalent to a roughness measure ranging from 150 to 600 grit and more preferably between 150 to 400 grit.

In one embodiment, adhesive materials on the inner surface can be used to increase the adhesion of the pressed powders to the side and/or bottom surfaces of the container, thereby further reducing cracking or chipping of the pressed powder as the pressed powder is consumed during application.

In another embodiment, the inner surface of the sidewall of the container can be sloped or curved to facilitate more even consumption of the pressed powder and less waste as the pressed powder is consumed from the container. This feature minimizes the situation encountered in conventional pan-like containers with straight sidewalls that are generally perpendicular to the bottom where the central portion of the pressed powder tends to be consumed, while the portions of the pressed powder proximate the sidewalls and/or in the corners of the container tend to be unused and ultimately discarded by the user. In a conventional pan-like container, these straight sidewalls tend to enhance the retention of the pressed powder within the container by providing the lateral force component pressing on the pressed powder. In this embodiment of the present invention, the surface features and/or adhesive layer on the bottom and side inner surfaces at least compensate for any loss of lateral pressure force component exerted by straight sidewalls, thereby permitting this embodiment of the present invention to utilize sloped or curved inner surface of the sides.

In a further embodiment, the containers or godets of the present invention can be organized together as part of a kit with multiple godets where each godet contains a different color and each godet further comprise a lid member operably coupled to the body portion of the container that can be selectively moved from an open position to a closed position. The plurality of godets in each kit may be stored in a case adapted to receive a plurality of godets. Additionally, each godet can include an adhesive layer and/or surface features positioned along the sidewalls and/or the bottom member of the godet to facilitate securing the pressed powder to the godet, which can reduce cracking and/or chipping of the pressed powder. In these embodiments, preferably the lid member can include a latch structure designed to engage and disengage with a corresponding structure on the body portion of the godet to secure the lid member to the body portion. Preferably, the lid member can be composed of a transparent polymer, which permits a user to distinguish the color of the colorized pressed powder stored in the godet without opening the lid. The kit may also include one or more applicators such as brushes, rollers, pads and the like.

DETAILED DESCRIPTION OF THE INVENTION

Figure 1:
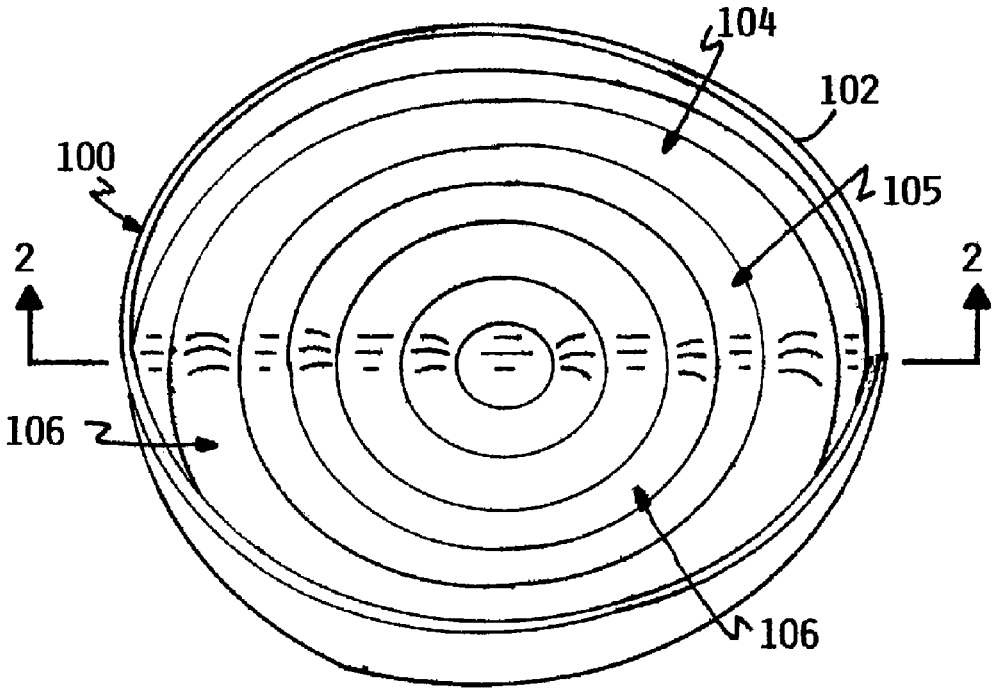
FIG. 1 is a perspective view of an embodiment of a conventional godet having ridges along the bottom surface of the godet that includes an adhesive layer in accordance with the present invention.
Figure 2:
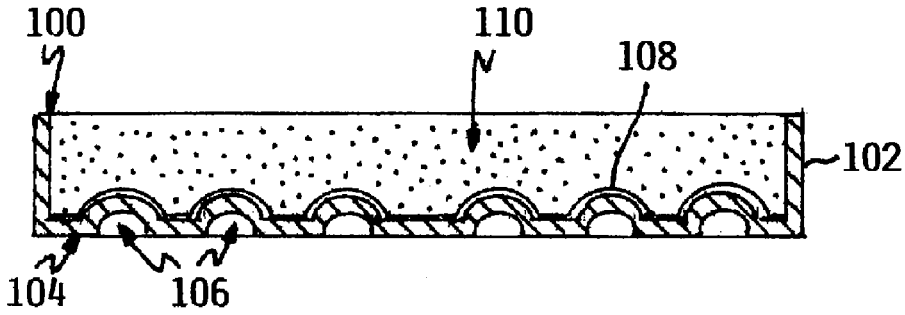
FIG. 2 is a cross-sectional view of the godet of FIG. 1 depicting an adhesive layer positioned along the side and bottom surfaces of the godet.
Figure 3:
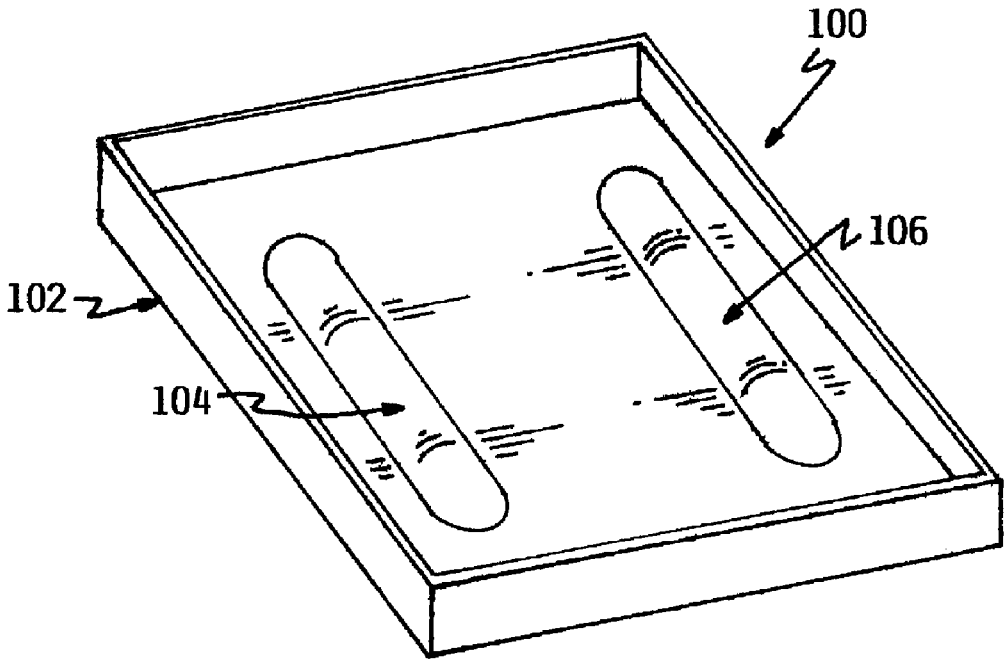
FIG. 3 is a perspective view of another embodiment of a conventional godet that includes an adhesive layer in accordance with the present invention.

As depicted in FIGS. 1-3, godet, or container, 100 is provided having sidewall 102 operably connected to, and extending around the perimeter of, bottom member 104 to define a recess area 105 adapted to receive and store a pressed powder 110. Godet 100 can include ridges 106 formed along the bottom member 104 to increase the structural integrity of godet 100. In some embodiments, as depicted in FIG. 1, godet 100 can have a substantially circular shape, while in other embodiments, as depicted in FIG. 3, godet 100 can have a rectangular shape. Typically, godets 100 will have a recess area 105 that ranges from about 2 $cm^2$ to about 100 $cm^2$, although one of ordinary skill in the art will recognize that no particular size or shape of godet 100 is required by the present disclosure.

In general, sidewall 102 and bottom portion 104 can be formed from any suitable materials including, for example, polymers, metals, metal alloys, cellulostic materials, fibrous materials such as fiber board, and combinations thereof. Suitable polymers include, for example, polyethylene (PE), high density polyethylene (HDPE), polypropylene (PP), polyvinylchloride (PVC), polycarbonates, polyurethanes, poly(tetrafluoroethylene) (PTFE), acrylonitrile-butadiene-styrene (ABS), styrene-acrylonitrile (SAN), nylon, and polyformaldehyde (Acetal) and combinations thereof. Suitable metals include, for example, tin, aluminum, titanium and alloys and combinations thereof.

As will be described, the containers 100 of the present invention preferably include one or more structural components that serve to increase the adhesion between the container and the pressed powder 110.

In one embodiment, as depicted in FIGS. 1-3, godet 100 includes an adhesive layer 108 that can increase the adhesion of pressed powder 110 to godet 100. In some embodiments, adhesive layer 108 can be applied to the inside surface of bottom member 104, sidewall 102, or a combination thereof. Although adhesive layer 108 is shown extending over generally all of the inner surfaces of bottom member 104 and sidewall 102, it will be understood that not all of those inner surfaces need to be coated with adhesive layer 108 to be within the intended scope of the present invention. In general, adhesive layer 108 can comprise any adhesive suitable for bonding a pressed powder to desired surfaces of godet 100 including, for example, solvent-based adhesives, water-based adhesives or a combination thereof. In one embodiment, the adhesive material is 2 Way Glue™ available from ZIG, manufactured by Kuretake Co., Ltd. Japan. Other suitable adhesives include, for example, epoxies, cyanoacrylates, urethane-based adhesives, urea-based adhesives, polymers containing tackifying agents, polyvinylacetate (PVA) adhesives, polyacrylate adhesives, and combinations thereof. Preferably, adhesive layer 108 is not formed of a thermally activated adhesive as the heating required to activate such an adhesive has the potential to damage and/or alter the chemical composition of pressed powder 110.

Adhesive layer 108 can be formed by coating a suitable adhesive material directly onto desired surfaces of godet 100. For example, an adhesive can be dissolved or dispersed in a suitable solvent to form a solvent/adhesive mixture, which can be coated onto desired surfaces of godet 100. The solvent can then be evaporated to produce an adhesive layer. Suitable coating methods include, for example, spray coating, dip coating, brush coating and combinations thereof. Additionally or alternatively, adhesive layer 100 can be formed by a positioning a double-sided adhesive membrane or tape onto desired surfaces of godet 100.

Figure 4:
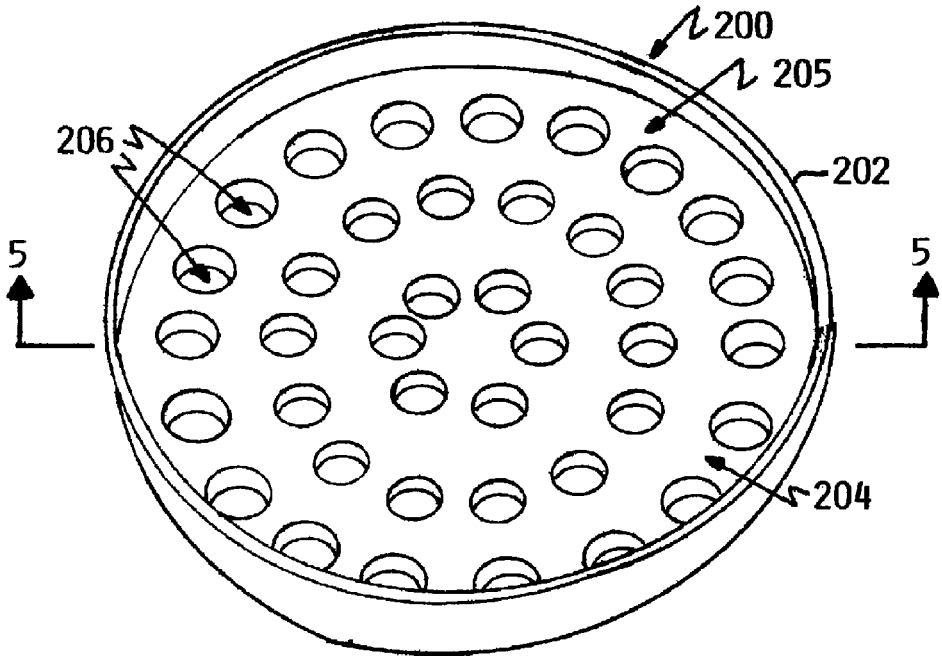
FIG. 4 is a perspective view of a godet having surface features in the form of cavities formed into the bottom surface of the godet.
Figure 5:
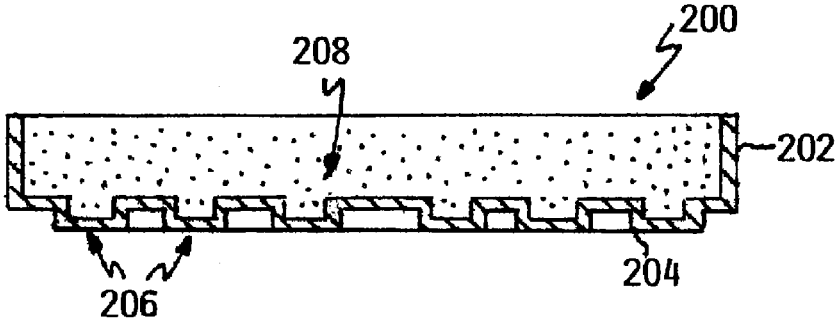
FIG. 5 is a cross-sectional view of the godet of FIG. 4, depicting a pressed powder formulation filling in the cavities in the bottom creating an effective mechanical interlock between the powder and the godet.

Referring to FIGS. 4 and 5, a godet 200 is depicted having sidewall 202 operably coupled to, and extending around the periphery of, bottom member 204 to define a recess area 205 adapted to receive and store a pressed powder. In this embodiment, bottom member 204 includes surface features that can facilitate mechanical interlocking between a pressed powder and the godet. As depicted in FIGS. 4 and 5, the surface features can be a plurality of cavities 206, which can facilitate a mechanical interlock with pressed powder 208. In other words, as depicted in FIG. 5, pressed powder 208 can generally interdigitate into cavities, or indentations, 206, which can help anchor pressed powder 208 in godet 200 such that pressed powder 208 better resists cracking and/or breaking during application of powder 208 to a desired substrate.

Figure 8:
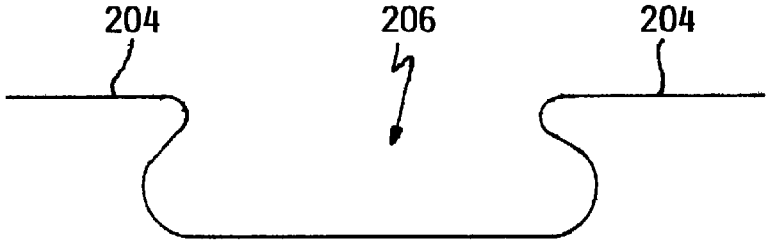
FIG. 8 is a cross-sectional view of one cavity having a generally mushroom shape including an undercut portion.

Cavities 206 can have any appropriate cross-sectional shape such as, for example, circular, substantially circular, elliptical, rectangular, and the like and combinations thereof. As depicted in FIG. 8, in one embodiment, cavities 206 can form a generally inverted mushroom-like shape with an undercut portion and curved edges proximate the top of each cavity so as to maximize the lateral force component on the pressed powder 210, while minimizing any sharp edges that may tend to form cutting edges for the pressed powder 210 and/or catch applicators once the level of powder has been consumed to the point where portions of the bottom surface of container 100 start to be exposed.

In some embodiments, cavities 206 can be randomly spaced along the surface of bottom member 204, while in other embodiments cavities 206 can be arranged in regular patterns along the surface of bottom member 204. Preferably, cavities 206 can have an effective diameter from about 0.5 mm to about 10.0 mm and a depth from about 0.3 mm to about 5.0 mm. Preferably, the surface area exposed by cavities 206 occupies from about 5 to about 65 percent of the recess area 205 of bottom member 204 defined by the perimeter of bottom member 204, and preferably from about 20 to about 40 percent of the recess area 205.

In other embodiments, the surface features can be achieved by a roughened surface formed into bottom member 204. In these embodiments, the roughened surface can be formed by chemical etching, sand blasting, mechanical abrasion blasted, peened, roll-textured, molded, electrically etched or similar techniques to simulate a texture of non-toothed sandpaper (i.e., not sharp but surface area coverage and grit size), as well as combinations thereof. In general, the roughened surface can contain microscopic holes or pores, which permit a pressed powder to mechanically interlock with the container, which can prevent cracking and breaking of the powder during application of the powder. In one embodiment, the surface features can be defined in terms of an equivalent surface area that is preferably at least twice, and more preferably at least three times, that of the surface area defined by the perimeters of the container. In another embodiment, the surface features create an equivalent roughness of the surface that is equivalent to a roughness measure ranging from 150 to 600 grit, and more preferably between 150 to 400 grit.

Figure 6:
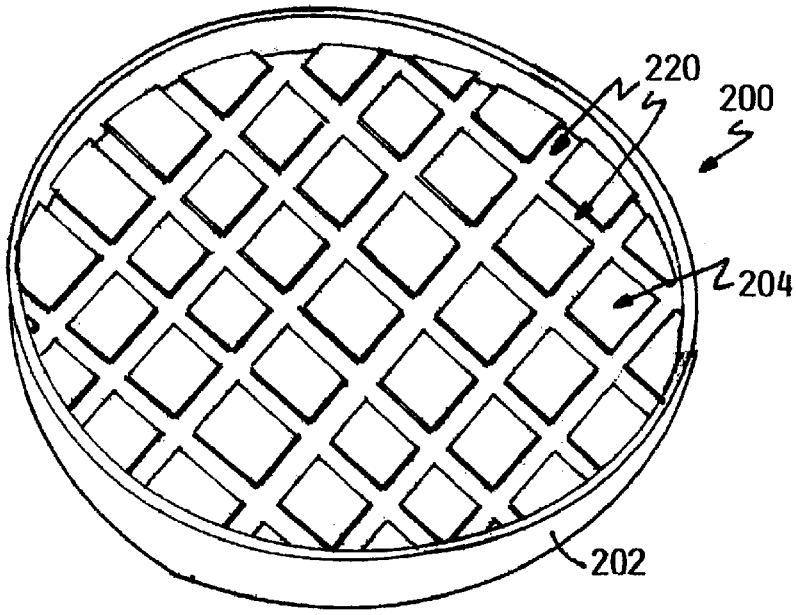
FIG. 6 is a perspective view of a godet having a plurality of channels formed into the bottom surface of the godet to facilitate mechanical interlocking of a pressed powder and the godet.

Referring to FIG. 6, in another embodiment, bottom portion 204 of godet 200 can include a plurality of channels 220, which can facilitate mechanical interlocking between godet 200 and pressed powder 210. As depicted in FIG. 6, in some embodiments, channels 220 can be formed in a crisscrossing arrangement along the surface of bottom portion 204. However, in other embodiments, channels 220 can be formed in a generally parallel relationship relative to each other along the surface of bottom portion 204. Godet 200 may further include an adhesive layer, as described above, coating the inside surface of sidewall 202 and/or bottom member 204. In one embodiment, channels 220 generally have a width of between 0.5 mm and 10.0 mm and a depth of between 0.3 mm to 5.0 mm and are preferably regularly spaced at intervals of between 0.5 mm to 10.0 mm.

Figure 7:
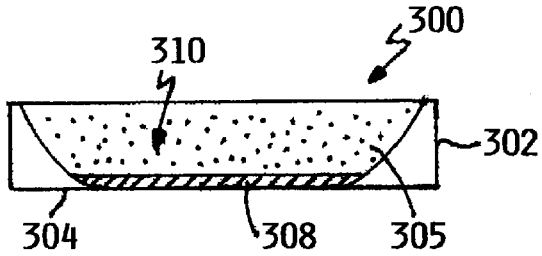
FIG. 7 is a cross-sectional view of godet having sloping side portions, which can reduce the build up of pressed powder in the corner or outer edge portion of the godet.

Referring to FIG. 7, godet 300 is depicted comprising sidewall 302 operably coupled to bottom member 304 to define a recess area 305 adapted to hold and store pressed powder 310. In these embodiments, sidewall 302 can be sloped, which prevents pressed powder 310 from accumulating in the corner and/or edge portions of godet 300. In some embodiments, an adhesive layer 308 can be positioned along an inside surface of bottom member 304 to increased the adhesion between godet 300 and pressed powder 310. Additionally, the inside surface of bottom member 304 may comprise protrusions, cavities and/or channels (not shown) to facilitate mechanical interlocking between godet 300 and pressed powder 310.

Figure 9:
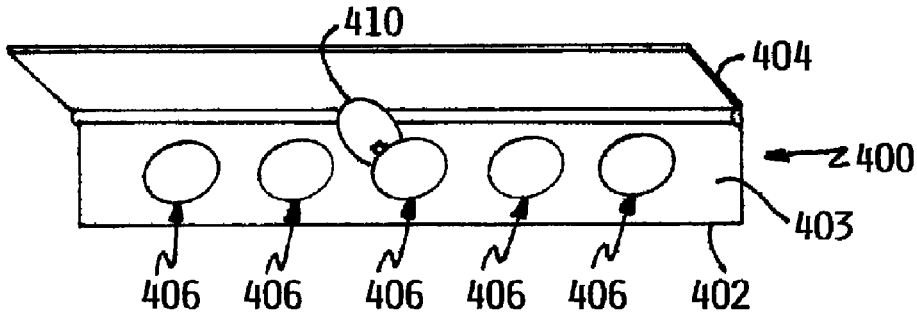
FIG. 9 is an isometric view of a case having a plurality of godets housed within the case, with one godet having a lid member in an open configuration.
Figure 10:
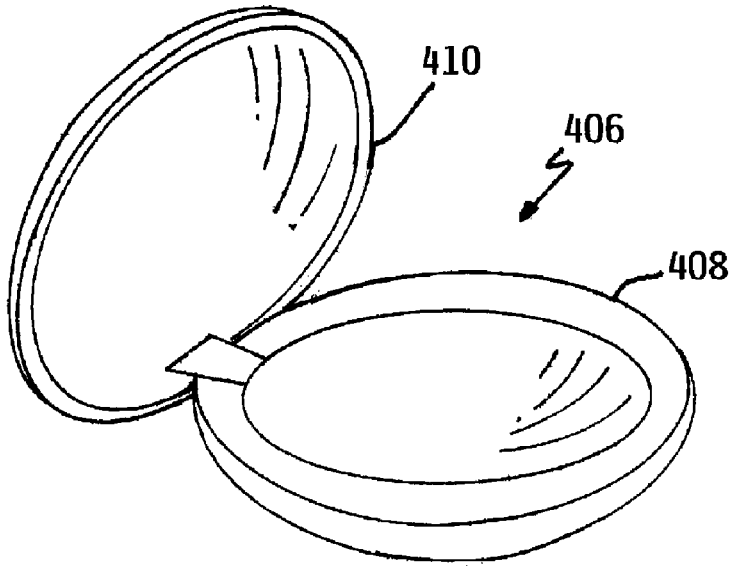
FIG. 10 is a perspective view of a godet having a lid member operably coupled to the godet, the lid member depicted in an open configuration.

Referring to FIGS. 9 and 10, a case 400 is depicted having body portion 402 operably coupled to lid portion 404. Generally, body portion 402 comprises one or more sidewalls operably coupled to a bottom member to define an interior portion 403. In one embodiment, the interior portion 403 can be adapted to receive a plurality of godets 406. In some embodiments, each of the plurality of godets can house a different colored pressed powder. Lid member 404 can be selectively moved from an open configuration, depicted in FIG. 8, to a closed configuration.

In some embodiments, as depicted in FIG. 9, each of the plurality of godets 406 can include a body portion 408 operably coupled to an individual lid member 410. Lid member 410 can be selectively moved between an open position, depicted in FIG. 10, and a closed positioned, which facilitates isolating a pressed powder located within body portion 408, which can reduce contamination of the pressed powder stored with godets 406. Additionally, in some embodiments, lid member 410 can be composed of a transparent material, which permits a user to identify the appearance of the pressed powder stored with a particular godet 406 without opening lid member 410.

Figure 11:
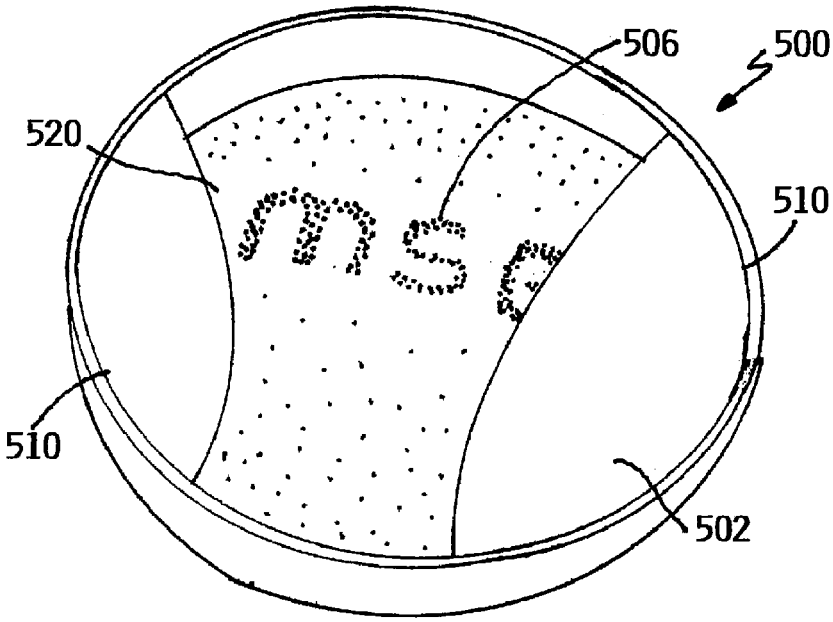
FIGS. 11 and 12 are perspective view of an alternate embodiment in which a graphic or message is formed by the surface features and/or adhesive layer in accordance with the present invention.
Figure 12:
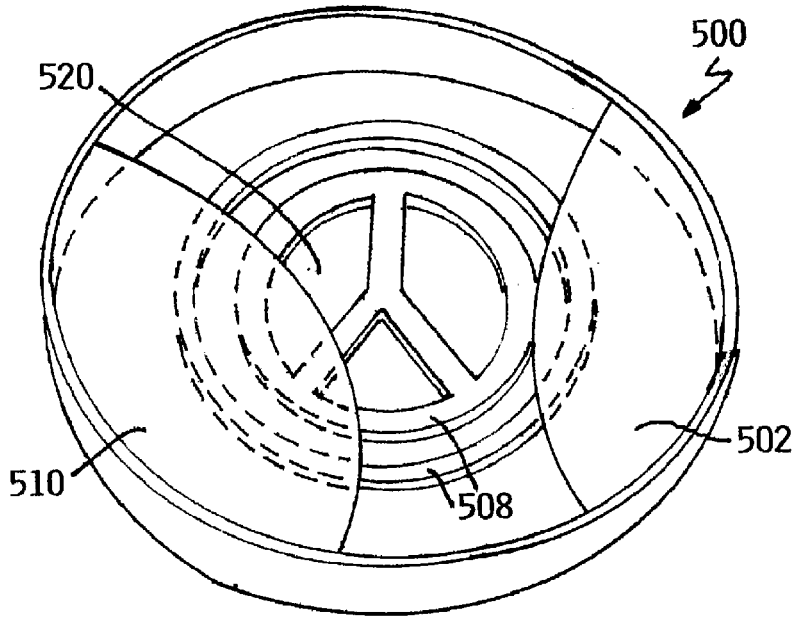

In another embodiment as shown in FIGS. 11 and 12, a pattern or message 520 can be defined in bottom portion 502 of container 500 by the arrangement of either the surface features 506, adhesive layer 508, or combination thereof. In this embodiment, as the pressed powder 510 is used from the container 500, areas of the bottom portion 502 have the pressed powder 510 removed, but the pressed powder 510 remains in those areas of the bottom portion 502 as retained by either surface features 506, as shown in FIG. 11, or adhesive layer 508, as shown in FIG. 12. Preferably, the pattern or message 520 can be used to display an alphanumeric message, initials, trademarks, or even graphics or design patterns.

The above embodiments are intended to be illustrative and not limiting. Additional embodiments are within the claims. Although the present invention has been described with reference to particular embodiments, workers skilled in the art will recognize that changes may be made in form and detail without departing from the spirit and scope of the invention.

What is claimed is:

1. A container for storing pressed powder material comprising:

a container having a bottom, at least one side and a top opening that defines a recess area;

surface features defined on the inner surface of at least the bottom of the container that create a generally lateral force component applied to the pressed powder material that resists cracking of the pressed powder material in response to removal of a portion of the pressed powder material from the top opening;

a non-thermally activated adhesive layer positioned generally along at least a portion of an inner surface of the bottom of the container; and a colorized pressed powder material positioned within the recess area on top of the surface features and adhesive layer, wherein the surface features include a plurality of indentations defined in at least the inner surface of the bottom of the container.

2. The container of claim 1 wherein the plurality of indentations occupy from about 5 to about 65 percent of the surface area of the bottom of the container.

3. The container of claim 1 wherein each of the plurality of indentations have a lateral cross section that includes an undercut region and a rounded upper edge.

4. The container of claim 1 wherein the plurality of indentations have an effective diameter from about 0.5 to about 10.0 mm.

5. The container of claim 1 wherein the plurality of indentations have an effective depth from about 0.3 to about 5.0 mm.

6. The container of claim 1 wherein the surface features are arranged in a pattern that is revealed when the pressed powder material is used down to a level generally at the bottom of the container.

7. The container of claim 1 wherein the at least one side includes an inner surface and an outer surface and wherein the outer surface is generally perpendicular to the bottom and the inner surface is curved relative to the bottom and merges into the bottom at a bottom of the inner surface and into the top of the outer surface of the side at a top of the inner surface.

8. The container of claim 1 wherein the adhesive layer is formed by a material selected from the set consisting of: a sprayed-on non-thermally activated adhesive material, a painted-on non-thermally activated adhesive material or a double sided adhesive film material.

9. A container for storing pressed powder material comprising:

a container having a bottom, at least one side and a top opening that defines a recess area;

surface features defined on the inner surface of at least the bottom of the container that create a generally lateral force component applied to the pressed powder material that resists cracking of the pressed powder material in response to removal of a portion of the pressed powder material from the top opening;

a non-thermally activated adhesive layer positioned generally along at least a portion of an inner surface of the bottom of the container; and a colorized pressed powder material positioned within the recess area on top of the surface features and adhesive layer, wherein the surface features have an effective roughness of between about 100 and 600 grit.

10. The container of claim 9 wherein the surface features have an effective roughness of between about 150 and 400 grit.

11. The container of claim 9 wherein the surface features are arranged in a pattern that is revealed when the pressed powder material is used down to a level generally at the bottom of the container.

12. The container of claim 9 wherein the at least one side includes an inner surface and an outer surface and wherein the outer surface is generally perpendicular to the bottom and the inner surface is curved relative to the bottom and merges into the bottom at a bottom of the inner surface and into the top of the outer surface of the side at a top of the inner surface.

13. The container of claim 9 wherein the adhesive layer is formed by a material selected from the set consisting of: a sprayed-on non-thermally activated adhesive material, a painted-on non-thermally activated adhesive material or a double sided adhesive film material.

14. A container for storing pressed powder material comprising:

a container having a bottom, at least one side and a top opening that defines a recess area;

surface features defined on the inner surface of at least the bottom of the container that create a generally lateral force component applied to the pressed powder material that resists cracking of the pressed powder material in response to removal of a portion of the pressed powder material from the top opening;

a non-thermally activated adhesive layer positioned generally along at least a portion of an inner surface of the bottom of the container; and a colorized pressed powder material positioned within the recess area on top of the surface features and adhesive layer, wherein the surface features have an effective surface area that is at least twice a surface area defined by a perimeter of the recess area.

15. The container of claim 14 wherein the surface features have an effective surface area that is at least three times a surface area defined by a perimeter of the recess area.

16. The container of claim 14 wherein the surface features are arranged in a pattern that is revealed when the pressed powder material is used down to a level generally at the bottom of the container.

17. The container of claim 14 wherein the at least one side includes an inner surface and an outer surface and wherein the outer surface is generally perpendicular to the bottom and the inner surface is curved relative to the bottom and merges into the bottom at a bottom of the inner surface and into the top of the outer surface of the side at a top of the inner surface.

18. The container of claim 14 wherein the adhesive layer is formed by a material selected from the set consisting of: a sprayed-on non-thermally activated adhesive material, a painted-on non-thermally activated adhesive material or a double sided adhesive film material.

* * * * *